US009370215B1

(12) United States Patent
Straus et al.

(10) Patent No.: US 9,370,215 B1
(45) Date of Patent: Jun. 21, 2016

(54) HELMET COVER

(71) Applicant: Protective Sports Equipment International, Inc, Chester Springs, PA (US)

(72) Inventors: Albert E Straus, Timonium, MD (US); Frank Lytle, West Chester, PA (US)

(73) Assignee: Protective Sports Equipment International Inc, Chester Springs, PA (US)

( * ) Notice: Subject to any disclaimer, the term of this patent is extended or adjusted under 35 U.S.C. 154(b) by 0 days.

(21) Appl. No.: 14/328,699

(22) Filed: Jul. 10, 2014

Related U.S. Application Data

(63) Continuation-in-part of application No. 13/791,813, filed on Mar. 8, 2013, now Pat. No. 8,776,272.

(60) Provisional application No. 61/608,450, filed on Mar. 8, 2012.

(51) Int. Cl.
*A42B 3/06* (2006.01)
*A42B 3/00* (2006.01)

(52) U.S. Cl.
CPC .. *A42B 3/06* (2013.01); *A42B 3/003* (2013.01)

(58) Field of Classification Search
CPC ..... A42B 3/00; A42B 3/061; A42B 3/066; A42B 3/069; A42B 3/127; A42B 3/06; A42B 3/003
USPC ..... 2/411
See application file for complete search history.

(56) References Cited

U.S. PATENT DOCUMENTS

| | | | | | |
|---|---|---|---|---|---|
| 2,296,335 | A | * | 9/1942 | Brady | 2/412 |
| 3,174,155 | A | * | 3/1965 | Pitman | 2/411 |
| 3,445,860 | A | * | 5/1969 | Rodell | 2/422 |
| 3,787,893 | A | * | 1/1974 | Larcher | 2/413 |
| 3,815,152 | A | * | 6/1974 | Bednarczuk et al. | 2/9 |
| 4,223,409 | A | * | 9/1980 | Lee | 2/411 |
| 4,599,752 | A | * | 7/1986 | Mitchell | 2/425 |
| 4,660,230 | A | * | 4/1987 | Mayling | 2/413 |
| 4,901,373 | A | * | 2/1990 | Broersma | 2/421 |
| 4,937,888 | A | * | 7/1990 | Straus | 2/411 |
| 4,996,724 | A | * | 3/1991 | Dextrase | 2/411 |
| 5,023,958 | A | * | 6/1991 | Rotzin | 2/411 |
| 5,088,129 | A | * | 2/1992 | Kamata | 2/411 |
| 5,519,895 | A | | 5/1996 | Barnes, Jr. | |

(Continued)

FOREIGN PATENT DOCUMENTS

WO WO2011121079 10/2011

*Primary Examiner* — Alissa L Hoey
(74) *Attorney, Agent, or Firm* — Invention To Patent Services; Alex Hobson

(57) ABSTRACT

A helmet cover that has an outer skin, an impact absorbing material and at least one vent comprising an aperture tough the helmet cover is described. A helmet cover vent may be aligned with a vent in a helmet, thereby providing for improved ventilation and cooling, and may be attached to a helmet. A helmet cover vent may be configured as a tapered or flared vent, and may be an air capture vent. The impact absorbing material may be configured over substantially the entire helmet cover surface, or may cover only a portion of the surface. In one embodiment, the impact absorbing material is configured as a discrete pad that is located where impact is most common, such as on the front, sides, or back of the helmet cover. A discrete pad may be interchangeable, allowing for customizing the type and location of impact absorption on the helmet cover.

16 Claims, 14 Drawing Sheets

(56) References Cited

U.S. PATENT DOCUMENTS

| | | | | |
|---|---|---|---|---|
| 5,522,091 | A | 6/1996 | Rudolf | |
| 5,628,071 | A | 5/1997 | Nezer | |
| 5,713,082 | A | 2/1998 | Bassette et al. | |
| 5,724,681 | A | 3/1998 | Sykes | |
| 5,732,414 | A | 3/1998 | Monica | |
| 6,029,283 | A * | 2/2000 | Comstock et al. | 2/422 |
| 6,154,889 | A | 12/2000 | Moore, III et al. | |
| 6,272,692 | B1 | 8/2001 | Abraham | |
| 6,282,724 | B1 | 9/2001 | Abraham et al. | |
| 6,314,586 | B1 | 11/2001 | Duguid | |
| 6,332,228 | B1 * | 12/2001 | Takahara | 2/422 |
| 6,360,376 | B1 * | 3/2002 | Carrington | 2/412 |
| 6,490,730 | B1 * | 12/2002 | Lyden | A41D 13/0153 2/22 |
| 7,243,378 | B2 * | 7/2007 | Desarmaux et al. | 2/423 |
| 7,254,843 | B2 | 8/2007 | Talluri | |
| 7,328,462 | B1 | 2/2008 | Straus | |
| 7,341,776 | B1 * | 3/2008 | Milliren et al. | 428/319.3 |
| 7,526,818 | B2 * | 5/2009 | Stinga et al. | A41D 13/0518 2/267 |
| 7,987,525 | B2 * | 8/2011 | Summers et al. | 2/425 |
| 8,156,570 | B1 | 4/2012 | Hockaday | |
| 8,166,573 | B1 * | 5/2012 | Chung et al. | 2/411 |
| 8,756,719 | B2 * | 6/2014 | Veazie | 2/411 |
| 8,776,272 | B1 * | 7/2014 | Straus et al. | 2/411 |
| 2005/0241049 | A1 * | 11/2005 | Ambuske et al. | 2/412 |
| 2011/0167541 | A1 * | 7/2011 | Chilson | 2/411 |
| 2011/0179557 | A1 * | 7/2011 | Rabie | 2/411 |
| 2011/0209272 | A1 * | 9/2011 | Drake | 2/411 |
| 2011/0307997 | A1 | 12/2011 | Blair | |
| 2012/0151663 | A1 * | 6/2012 | Rumbaugh | 2/411 |
| 2012/0180199 | A1 * | 7/2012 | Chilson et al. | 2/411 |
| 2012/0192337 | A1 | 8/2012 | Divine et al. | |
| 2012/0317705 | A1 * | 12/2012 | Lindsay | 2/413 |
| 2013/0283504 | A1 * | 10/2013 | Harris | 2/411 |
| 2013/0340149 | A1 * | 12/2013 | Richwine | 2/422 |

* cited by examiner

HELMET COVER

CROSS REFERENCE TO RELATED APPLICATIONS

This application is a continuation in part of U.S. patent application Ser. No. 13/791,813 filed on Mar. 8, 2013, entitled HELMET COVER and currently pending, which claims priority from U.S. Provisional Application No. 61/608,450 filed on Mar. 8, 2012, entitled HELMET COVER; both of which are incorporated herein by reference in their entirety.

BACKGROUND OF THE INVENTION

1. Field of the Invention

The present invention relates to detachably attachable helmet covers having vents configured therein.

2. Background

Repetitive impact to the head can lead to very serious ad long-term injuries and related issues. Research in this field is raising awareness of Chronic Traumatic Encephalopathy (CTE), a progressive degenerative disease, diagnosed post-mortem in individuals with a history of multiple concussions and other forms of head injury. Football players, boxers, and other athletes that sustain repetitive impacts to the head may be susceptible to this very serious condition. Therefore, it is important that measures be taken to protect athletes and to reduce their risks.

Helmet covers having impact absorbing materials have been described, however, they lack adequate versatility for various sports and in particular, lack ventilation means which may lead to athletes becoming overheated. Many athletes may decide not to use a helmet cover because they are too heavy, cannot be configured to their particular sport, or because they don't have adequate ventilation. A helmet may have vents to allow air to move into the helmet and actively cool a player's head. In addition, vents may allow for heat from the athlete's head to escape, thereby providing passive cooling.

There exists a need for a helmet cover that comprises impact absorbing material and comprises vents to allow for air flow from the helmet through the helmet cover. Furthermore, there exists a need for a helmet cove that can be quickly and easily detached, and reattached to a helmet.

SUMMARY OF THE INVENTION

The invention is directed to a helmet cover, and helmet comprising a helmet cover, that has an outer skin, an impact absorbing material and at least one vent comprising an aperture through the helmet cover. The impact absorbing material may be configured over substantially the entire helmet cover surface, or may cover only a portion of the helmet surface. In one embodiment, the impact absorbing material is configured as a discrete pad, in locations where impact is most common, such as on the front, sides, or back of the helmet. The impact absorbing material may be configured under the outer skin, or partially under the outer skin. There may be areas were the outer skin is absent and the impact absorbing material may be exposed to, or sere as, the outer surface of the helmet cover. In other embodiments, the impact absorbing material may be a discrete pad that may be interchanged or replaced as required. A vent may couple with an inner surface flow enhancer feature configured to distribute a flow of air from a vent over the inner surface and between the helmet cover and the helmet. An inner surface of the helmet cove may comprises a decouping feature configured to allow the helmet cover to slide or slip slightly during an impact, thereby reducing rotational or spin forces. In addition, the outer surface of a helmet cover may be configured with deflection feature, such as a plurality of protrusion or dimples that are configured to reduce the outer most contact surface area and reduce impact through deflection. The reduced outer most contact surface area is configured to reduce friction of an impact.

An exemplary helmet cover, as described herein, is designed to significantly reduce injury from sustaining an impact through a number of different mechanism. First, the outer skin and impact absorbing material are configured to dissipate and distribute an impact over a larger area. The harder outer skin causes an impact to be absorbed by a larger portion of the impact absorbing material as it deflects much less than the soft impact absorbing material. In addition, the helmet cover configured over a helmet provides an additional dissipation and distribution of load to the helmet. Second, the helmet cover may comprise a deflecting feature that is configured to deflect an impact off and away from the helmet. A deflecting feature is configured to reduce friction at an impact location by reducing the outermost ara and/or by incorporating a low friction material. The outer surface, or outer skin, may comprise a plurality of dimples and/or protrusions that reduces the outermost surface area; such that an object hitting the outer skin will be more likely to glance off rather than stick and cause greater impact and or twisting of the helmet cover. The outer skin may also comprise a low friction material to further reduce friction. Any suitable low friction material may be used, such as a hard plastic, a fluoropolymer material and the like. Twisting or torsional force caused by an impact can be very serious, as they sometimes lead to neck fractures, for example. Third, a helmet cover may comprise a decoupling feature, such as ribs, dimples or protrusions that extend along the inner surface of the helmet cover and between the helmet cover and the outer portion of a helmet. A decoupling feature will allow the helmet cover to move and/or twist relative to the helmet it is configured on. This relative motion of the helmet cover with respect to the helmet allows the helmet cover to dampen an impact and especially an impact that causes the helmet cover to twist.

An exemplary helmet cover comprises one or more discrete and interchangeable pads that enables a user to tailor the helmet to their particular activity or situation. For example, a linesman in football may choose to install a thicker more impact absorbing, discrete pad in the front of the helmet where he sustains impact with almost every play. The linesman may choose to have thinner or less impact absorbing material in other portions of the helmet. Likewise, an ice hockey player that may sustain impact to the back of the head when they fall, may choose to have a thicker, or more energy absorbing discrete impact material on the back of his/her helmet. A higher impact absorbing material may be thicker or perhaps heavier than a lower impact absorbing material and therefore, an athlete or user of the helmet cover may select the type and location of impact absorbing material for their sport. Discrete interchangeable pads may comprise different types of impact absorbing materials such as foams of different density, foams of different material sets and/or thickness and the like. In addition, a discrete pad may comprise an outer and/or inner skin layer.

An impact absorbing material, as used herein, is defined as a compressible material that may be used to disperse, dampen, and/or dissipate an impact and includes, but is not limited to, elastomeric materials, open and closed cell foam materials, pleated fabrics, fabrics, gels, or gel filled pouches, composite materials and the like. The impact absorbing material may be a resilient impact absorbing material that effectively returns substantially to its original shape being compressed and deformed. Alternatively, the impact absorbing material may be a non-resilient impact absorbing material that does not return to its original shape after being compressed and deformed, such as styrofoam. An impact absorbing may be made out of a material that has a shore A hardness of about 60 or less, about 40 or less, about 30 or less, about 20 or less and any range between and including the values provided.

The impact absorbing material may have any suitable thickness including, but not limited to greater than about 1 cm, greater than about 2 cm, greater than about 3 cm, greater than about 4 cm, greater than about 6 cm, greater than about 8 cm and any range between and including the thickness values provided. In one embodiment, the thickness of the impact absorbing material is reactively uniform over the surface of the helmet, not including openings and vents. In another embodiment, the thickness of the impact absorbing material may be varied from location to location, whereby a helmet cover may be adapted for a particular sport or activity. In addition, as previously described, the impact absorbing material may be a discrete pad that may be available in a variety of thicknesses.

The helmet cover, as described herein, may comprise an inner skin, whereby the impact absorbing material may be configured between the inner and outer skins. The outer skin of the helmet cover may be any suitable material and is preferably a thin, tough, hard plastic that can withstand impact without breaking or splitting. The outer skin and/or inner skin may comprise any suitable material including plastic, epoxy, elastomer, metal, composite materials and the like. The thickness of the outer skin and/or inner skin may be any suitable thickness including, but not limited to, greater than about 0.5 mm, greater than about 1mm, greater than about 2 mm, greater than about 5 mm and any range between and including the thickness values provided. The outer skin and in some embodiments, the inner skin, are configured to have a higher hardness than the impact absorbing material, wherein a blow to the outer skin is distributed over a larger area of the impact absorbing material as the outer skin deflects from the impact. The outer skin and/or inner skin may be made out of a material that has a shore A hardness of about 40 or more, about 60 or more, about 80 or more and any range between and including the values provided.

In an exemplary embodiment, the outer skin comprises a polyurethane. The outer skin may be attached to the impact absorbing material through any suitable means including, but not limited to, adhesives, fasteners, welds, clips, snaps, hook and loop fasteners and the like. In one embodiment, the outer skin and/or the inner skin is an integral skin, whereby the skin layer is formed with, and is integrally attached to, the impact absorbing material. For example, a mold in the shape of a helmet cover may be filled with a polyurethane composition that forms a thin hard skin along the interface surface with the mold, but otherwise forms a compressible foam, or impact absorbing material. When the helmet cover is removed from the mold, the integral skin is integrally attached to the foam or impact absorbing material.

The helmet cover, as described herein, may be configured to be detachably attached to a helmet. Any suitable attachment feature may be used to attach the helmet cover to a helmet including, but not limited to, adhesives, fasteners, elastic bands, welds, clips, snaps, hook and loop fasteners and the like. In one embodiment, an attachment feature comprises an integral extension of an inner or outer skin that may be configured as attachment tabs. For example, the outer kin of the helmet cover may extend beyond the impact absorbing material and be configured to fold into an opening or around the edge of the helmet. The integral extension or tab may comprise a snap, one side of a hook and loop fastener or the like, for attaching the helmet cover to the helmet. The helmet may comprise a corresponding attachment element for securing the helmet cover to the helmet. For example, a helmet cover may comprise an integral extension inner skin having the hook side of a book and loop fastener, and the inside edge of a helmet may comprise the loop side of the hook and loop fastener, enabling the helmet cover to be quickly and easily attached and detached from a helmet. In an alternative embodiment, the helmet cover may be more permanently attached to a helmet with an adhesive or fasteners, for example.

The helmet cover, as described herein, may comprise at least one vent. A vent may be configured to align with a vent in the helmet, thereby forming an aligned vent that extends through the helmet cover and the helmet. An aligned ent, as defined herein, is a vent in a helmet cover having an inner surface opening that overlaps with at least a portion of a vent in a helmet when the helmet cover is attached to the helmet. More simply stated, it aligns with a vent in the helmet.

The helmet cover, as described herein, may comprise any suitable number of vents including, but not limited to, at least one, at least two, at least three, at least four, at least five, at least six, at least eight, ten or more, and any range between and including the number of vents provided. In one embodiment, a helmet cover comprises two vents on the top of the helmet and a vent on either side of the helmet, for a total of four vents. In another embodiment, at least one vent is configured on the front portion of the helmet and another vent is configured on the back portion of the helmet. These two vents may be couple by an inner surface flow enhancer and a flow of air may enter the front vent and exit through the back when a person donning the helmet cover is running in a forward motion.

A vent may have any suitable shape and size and may be round, oblong, oval, or any other shape. The open area or size of the opening of a vent on the outside or inside surface may have any suitable area including, but not limited t, greater than about 2 $cm^2$, greater than about 3 $cm^2$, grater than about 4 $cm^2$, greater than about 5 $cm^2$, greater than about 8 $cm^2$, greater than about 10 $cm^2$ greater than about 15 $cm^2$, and any range between and including the areas provided. A vent may have a relatively constant cross sectional area through the thickness of a helmet cove, or may be tapered or flared. A tapered vent has a larger open ara on the outside surface of the helmet cover, than the open area on the inside surface of the helmet cover. A flared vent has a smaller open area on the outside surface of the helmet cover, than the open area on the inside surface of the helmet cover. A tapered vent may funnel more air into a helmet, and a flared vent may allow for more heat to escape from a user's had.

A vent may be configured as an air capture vent, wherein the vent opening on the outside surface of the helmet cover is not planar with the outer surface of the helmet cover. For example, a vent on the top of a helmet cover may have a front opening on the outside surface of the helmet cover with a front side or leading opening edge that is recessed from a backside or trailing opening edge. In this way, air moving over the outer surface of the helmet cover is more likely to be funneled into the vent opening.

The helmet cover, as described herein, may comprise an outer surface flow channel feature, or a recess in the contour of the outer surface of the helmet cover. In one embodiment, an outer flow surface flow channel may be configured with a vent. For example, a vent may be configured at the trailing end of an outer flow channel feature, and may further be an air-capture vent. An outer surface flow channel feature may have any suitable shape and configuration, and in one embodiment the leading width is larger than the trailing width.

The helmet cover, as described herein, may comprise at least one inner surface flow enhance feature, or a protrusion, recess, or channel configured on the inner surface and extending along at least a portion of the inner surface. An inner surface flow enhancer feature may comprise a plurality of recess or protrusions that extend to an inner surface open area of a vent. An inner surface flow enhancer feature may extend to the leading edge of a helmet cover, whereby air enters the flow enhancer feature at the leading edge of the helmet and flows between the helmet cove and helmet. An inner surface flow enhancer may extend to any edge portion of a helmet cover. In one embodiment, an inner surface flow enhancer feature extends from the leading edge of a helmet cover to a trailing edge of the helmet cover. In another embodiment, an inner surface flow enhancer feature extends between a first and a second vent aperture. In an exemplary embodiment, an inner surface flow enhancer feature extends from a first vent aperture in the front portion of the helmet to a second vent aperture configured in the back portion of the helmet. A vent may be configured to create a low pressure and draw air out of the vent when air passes over the vent. A vent may be configured to produce this low pressure through the venturi effect, whereby air rushing over an orifice creates a suction force to draw air out of the orifice. A vent configured on the back of the helmet may be a venturi vent and this vent may be coupled, by an inner surface flow enhancer, with a second vent, such as one configured in the front portion of the helmet.

In an exemplar embodiment, a helmet cover comprises a deflection feature configured over at least a portion of the outer surface of the helmet cover. A deflection feature is configured to reduce friction between the helmet cover and an impacting article. A deflection feature may comprise a plurality of protrusion and/or dimples that reduced the outermost surface area of the helmet cover. In another embodiment, a low fraction material, such a fluoropolymer may be incorporated on the exterior of the helmet cover to reduce friction.

In an exemplary embodiment, a helmet cover comprises a decoupling feature that is configured on the inner surface of the helmet cover to allow the helmet cover to move and/or rotate with respect to the helmet. A decoupling feature reduces the contact area between the inner surface of the helmet cover and the outer surface of a helmet and may comprise protrusion from the inner surface of a helmet cover, protrusions into the inner surface of a helmet cover, or any combination thereof. A decoupling feature may comprise one or more ribs, protrusions or dimples. A decouping feature may extend out from the inner surface of the helmet cover to reduce contact area between the helmet cover and the helmet. Any suitable number of decouping features may be configured along the inner surface of the helmet cover and they may comprise any suitable material. In one embodiment, a decoupling feature comprises an impact absorbing material that further dampens a blow as the decoupling feature will be required to compress before a larger portion of the impact absorbing material engages with the outer surface of the helmet. A decouping feature, such as a rib or protrusion, may comprise a hard and rigid material or a hard outer skin to further reduce friction between the decoupling feature and the outer surface of the helmet. A decoupling feature made out of rigid material may be an elongated member that will flex to dampen and distribute an impact.

In one embodiment, the helmet cover comprises an outer and inner skin with an impact absorbing material configured there between, and a plurality of air capture vents comprising an aperture through the helmet cover.

The helmet cover or helmet comprising said helmet cover, described herein, may be configured for use with any suitable type of helmet including, but not limited to, sports and recreational activity helmets, impact sport helmets, team impact sport helmets, military helmets, emergency personal helmets, protective services helmets, such as riot police helmets, industrial work helmets, children's helmets, special needs helmets, health care helmets and the like.

The summary of the invention is provided as a general introduction to some of the embodiments of the invention, and is not intended to be limiting. Additional example embodiments, including variations and alternative configurations of the invention, are provided herein.

BRIEF DESCRIPTION OF THE DRAWINGS

The accompanying drawings are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
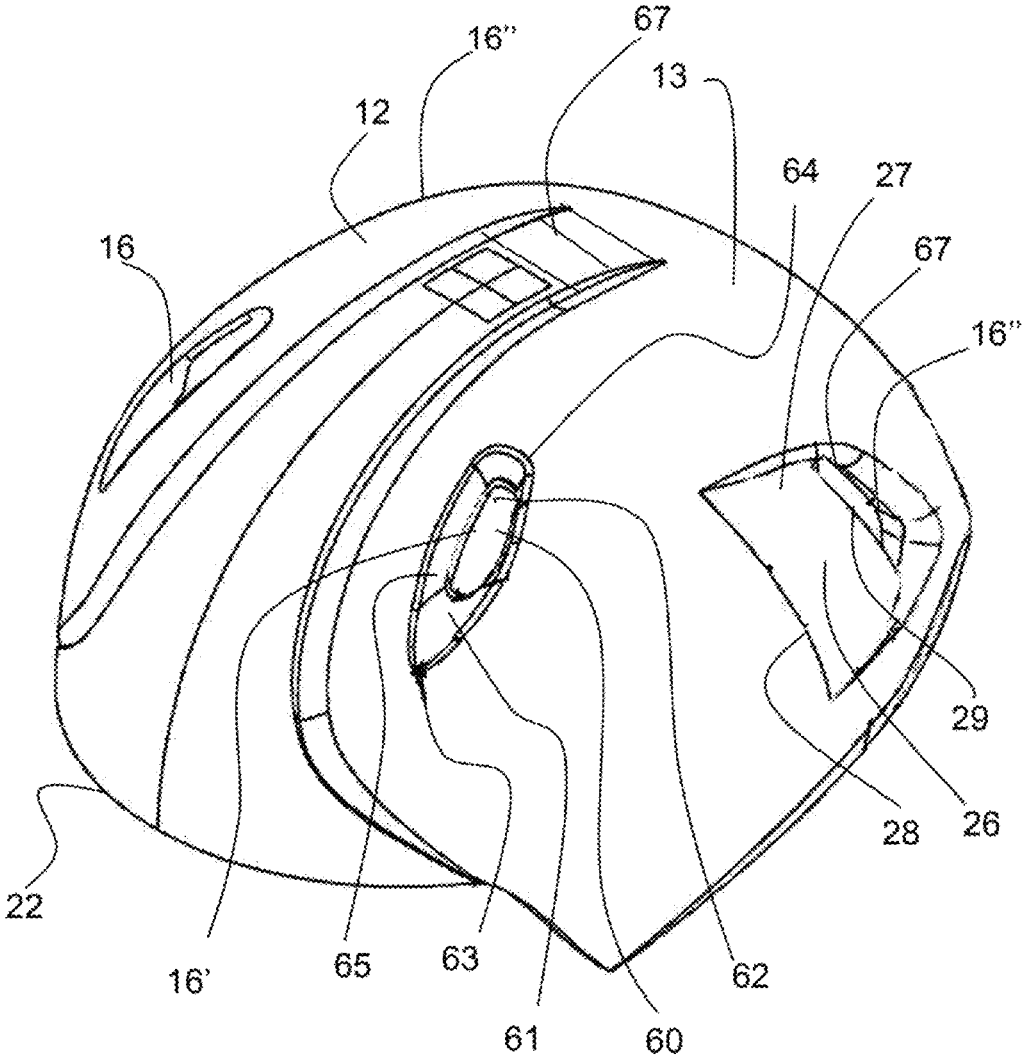

FIG. 1 shows an isometrc view of an exemplary helmet cover having a plurality of vents.

Figure 2:
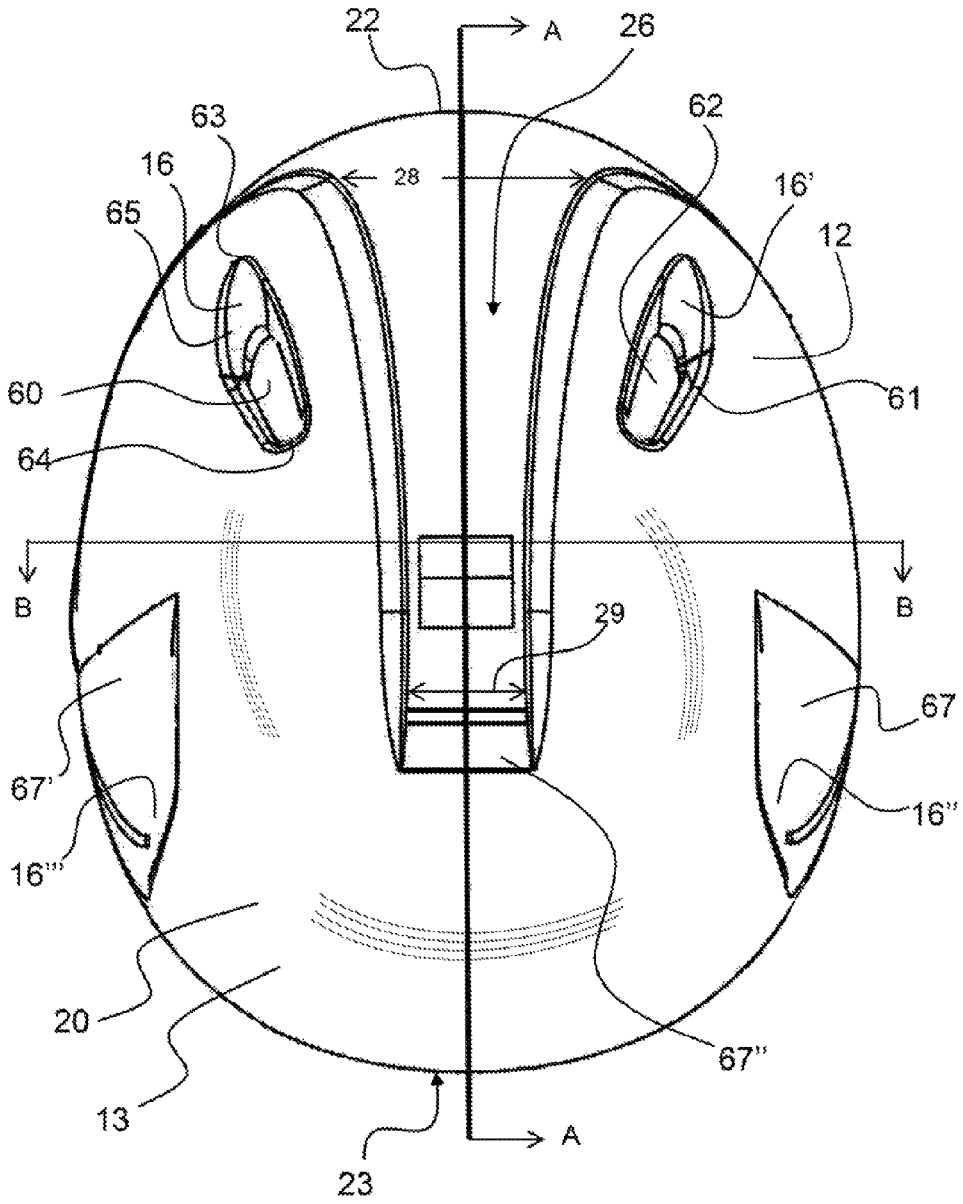

FIG. 2 shows a top down view of the exemplary helmet cover shown in FIG. 1, having a plurality of vents.

Figure 3:
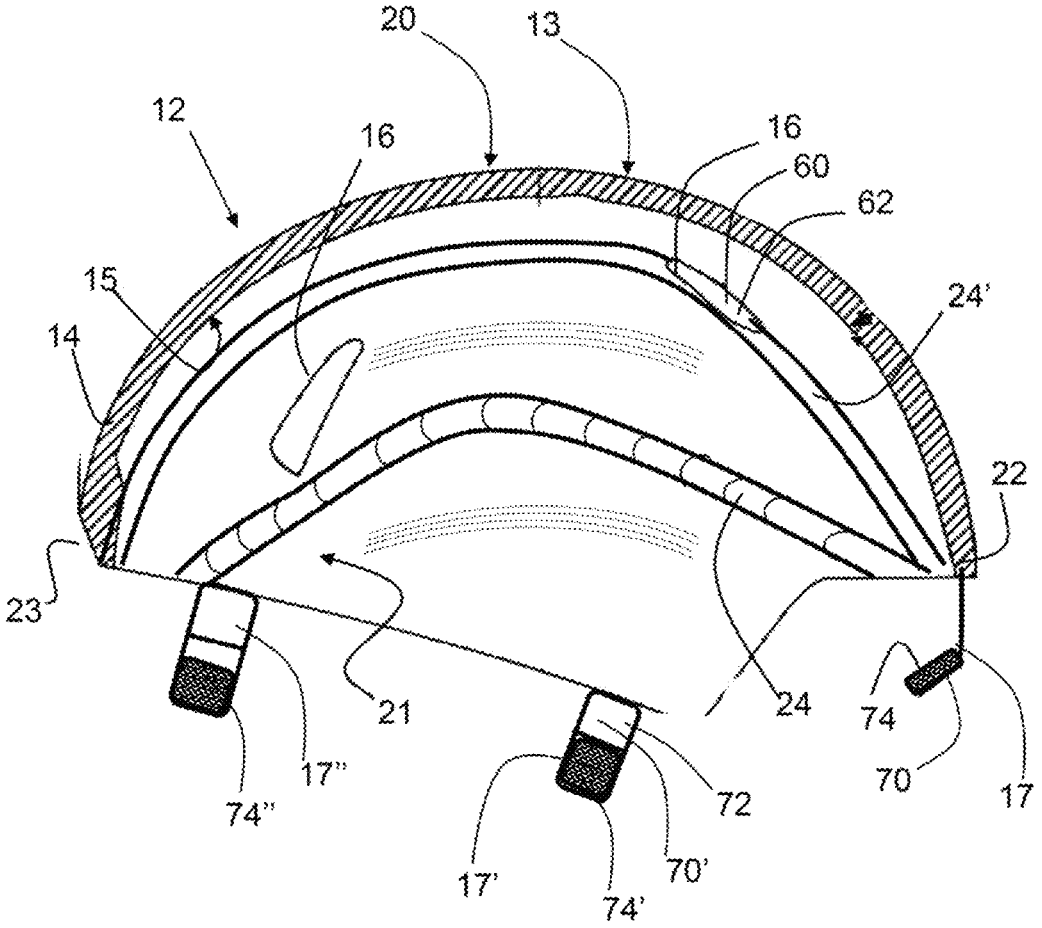

FIG. 3 shows a cut-away side view the inner surface of an exemplary helmet cove having attachment features and inner surface flow enhancer features.

Figure 4:
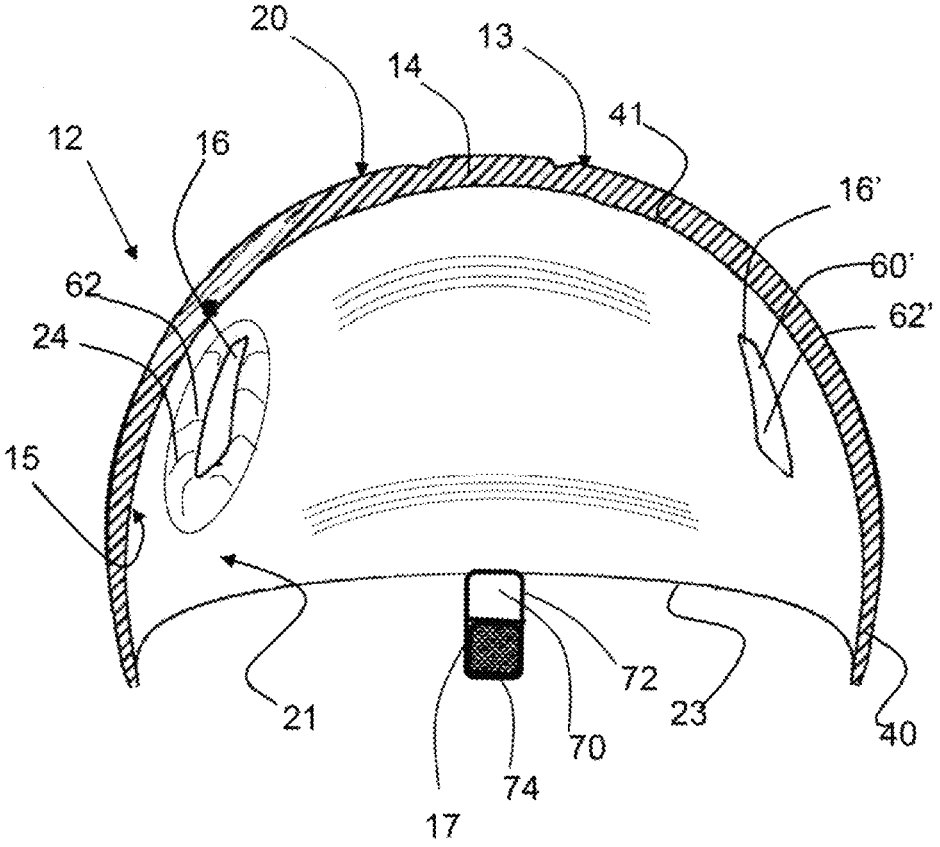

FIG. 4 shows a cut-away view of an exemplary helmet cover having an attachment feature and an inner surface flow enhancer feature.

Figure 5:
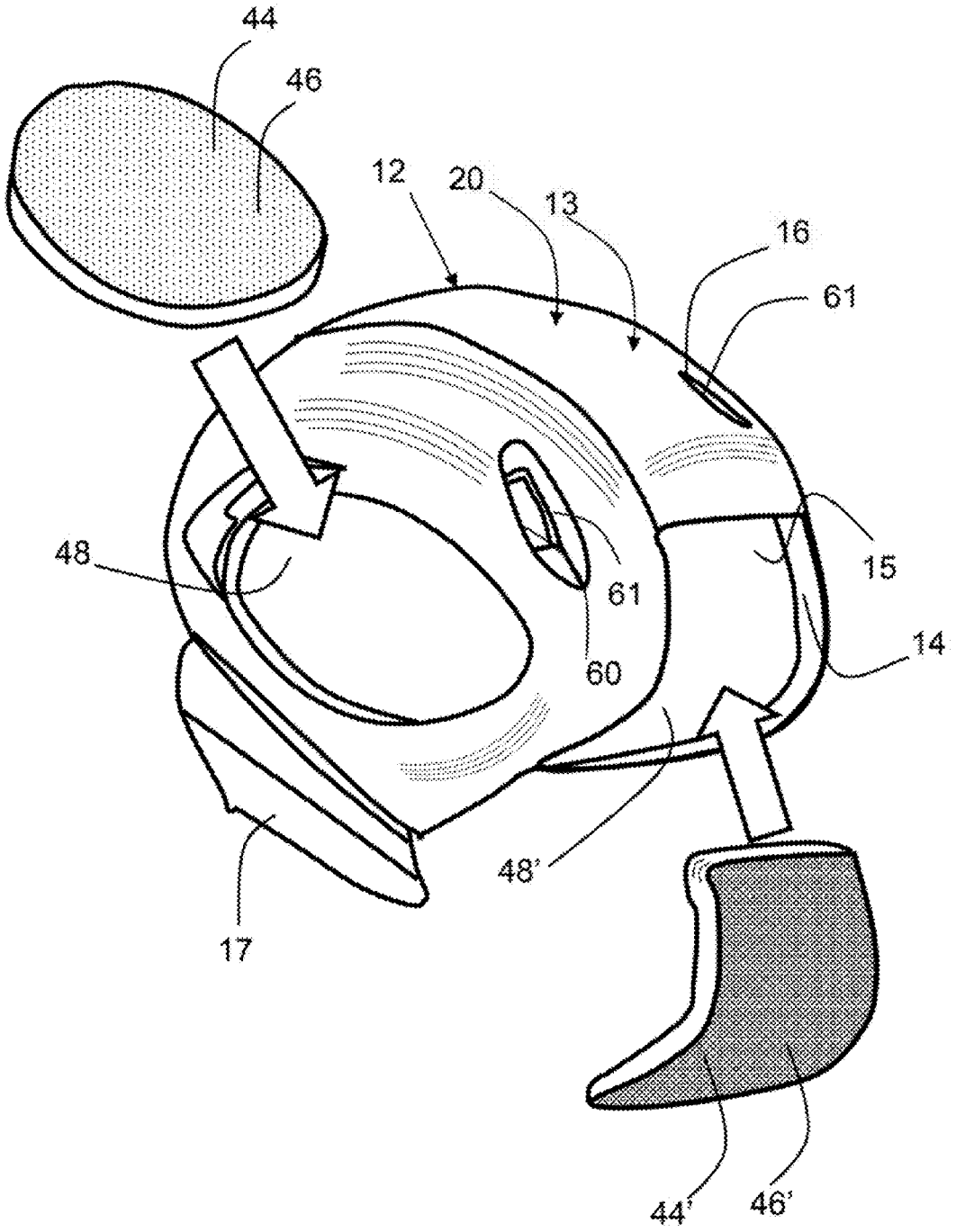

FIG. 5 shows an isometric view of an exemplary helmet cover having interchangeable pads.

Figure 6:
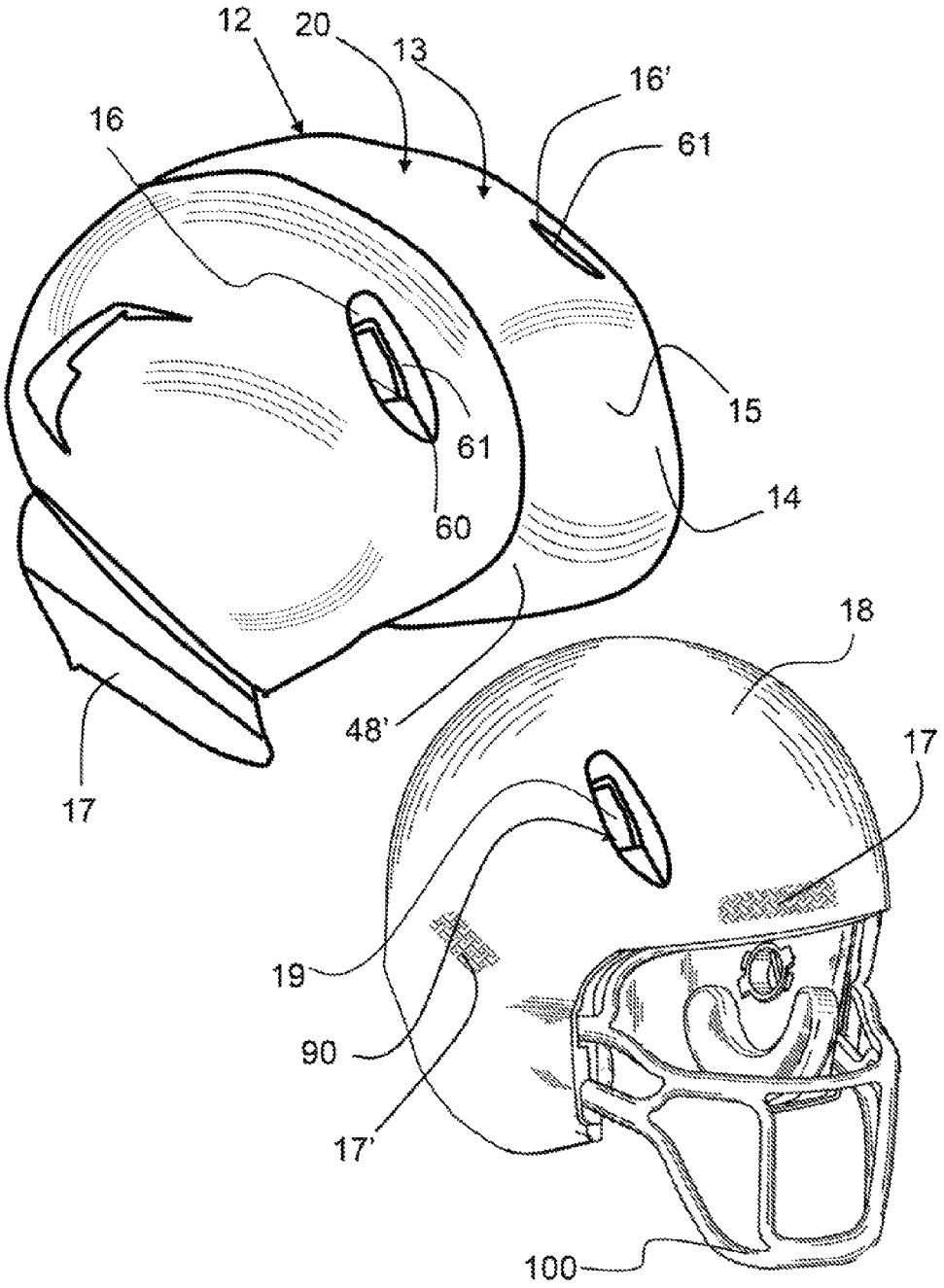

FIG. 6 shows an isometric view of an exemplary helmet cover having a vent opening configured to at least partially align with a vent opening in a helmet.

Figure 7:
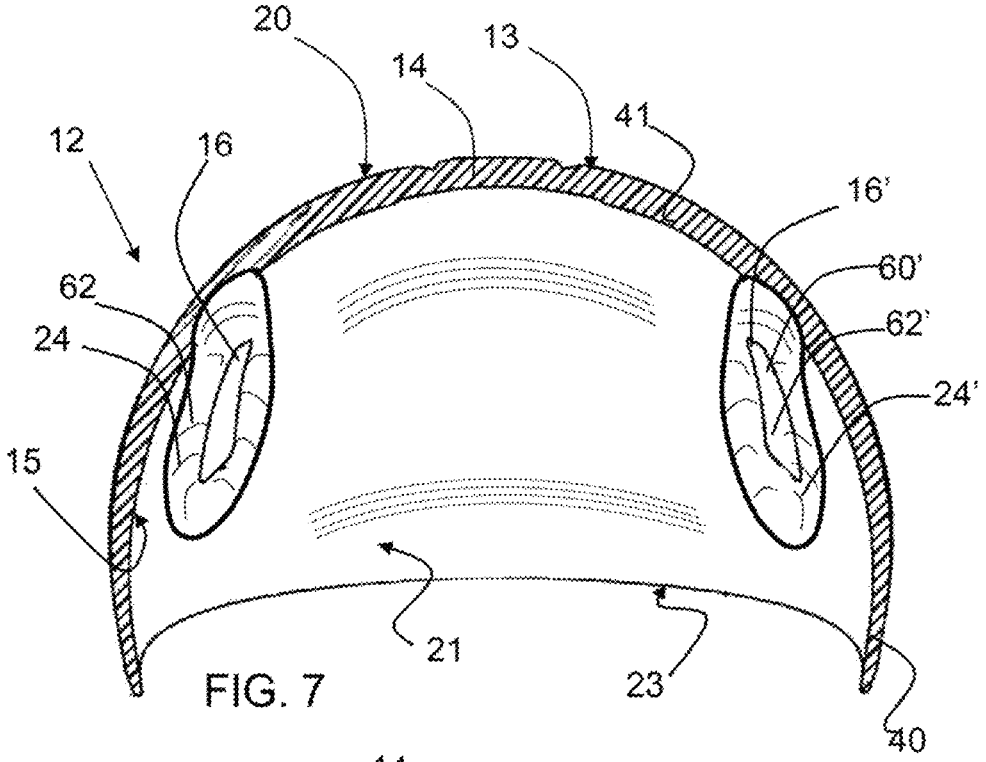

FIG. 7 shows a cut-away view of an exemplary helmet cover having an inner surface flow enhancer feature.

Figure 8:
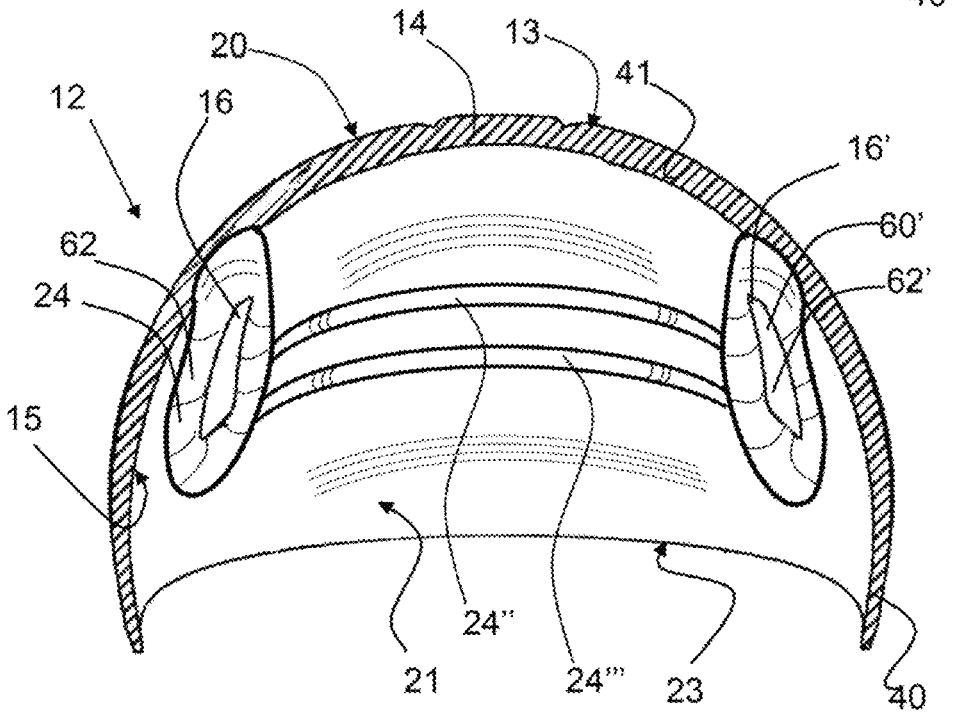

FIG. 8 shows a cut-away view of an exemplary helmet cover having an inner surface flow enhancer feature that extends between to vents.

Figure 9:
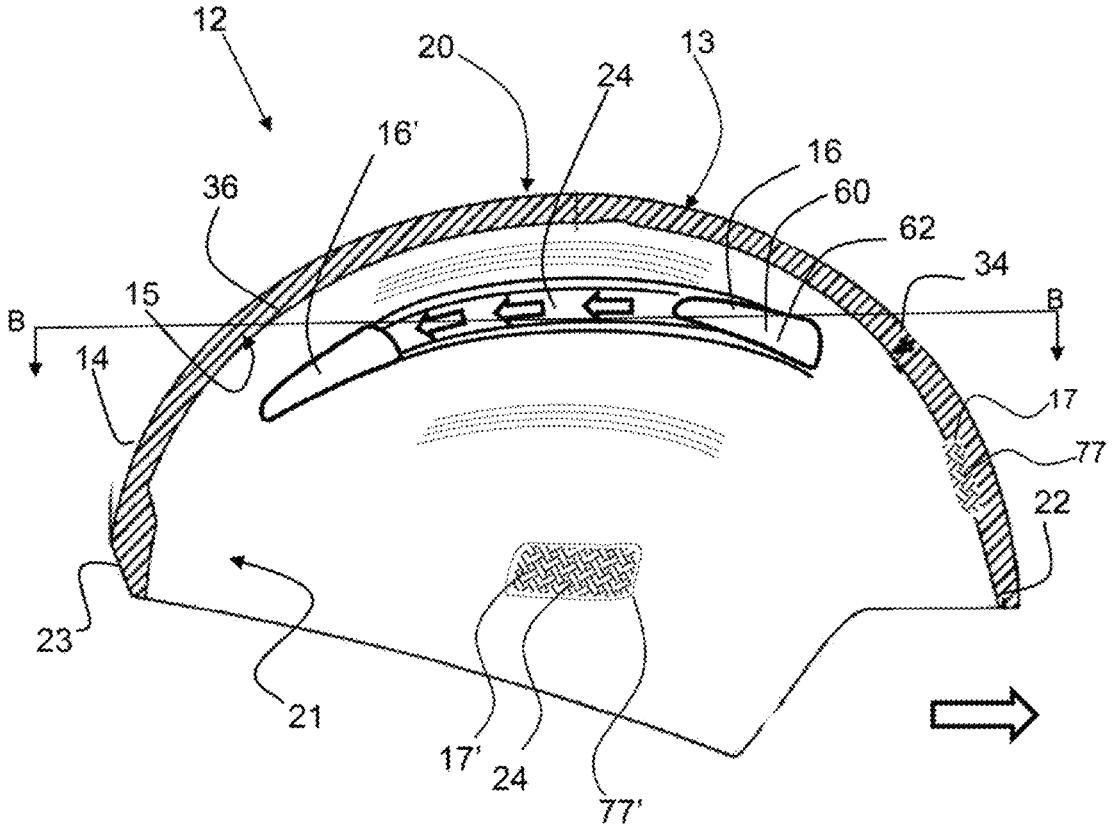

FIG. 9 shows a cut-away view of an exemplary helmet cover having an inner surface flow enhancer feature that extends between a vent configured in the front portion of the helmet cover and a vent configured in the back portion of the helmet cover.

Figure 10:
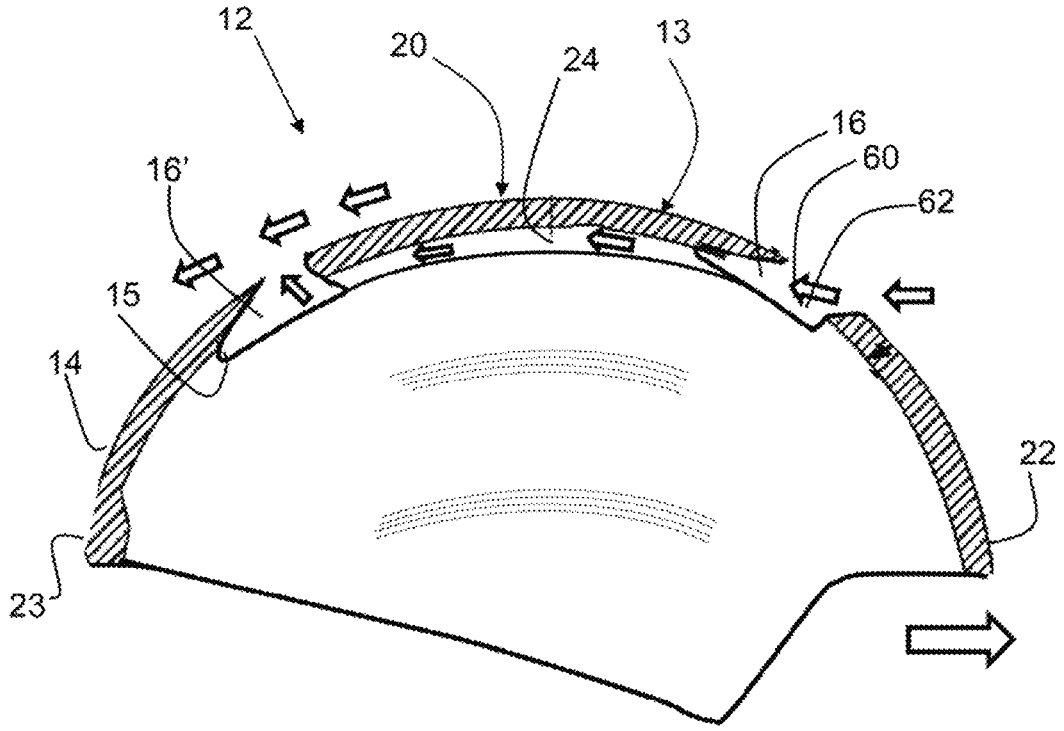

FIG. 10 shows a cut-away view of the exemplar helmet cover shown in FIG. 9 along line B, having an inner surface flow enhancer feature that extends between a vent configured in the front portion of the helmet and a vent configured in the back portion of the helmet.

Figure 11:
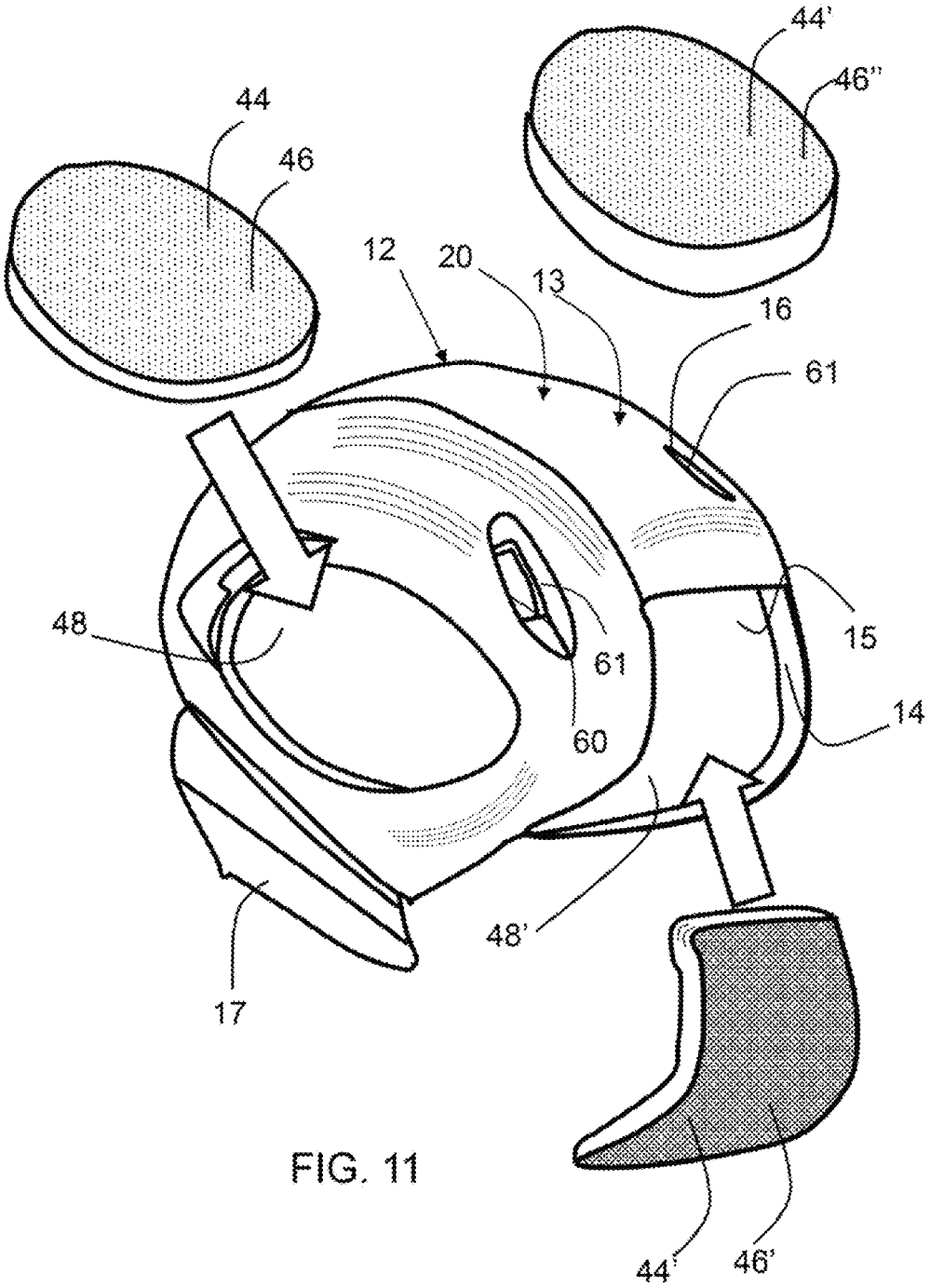

FIG. 11 shows an isometric view of an exemplary helmet cover having a plurality of different thickness interchangeable pads.

Figure 12:
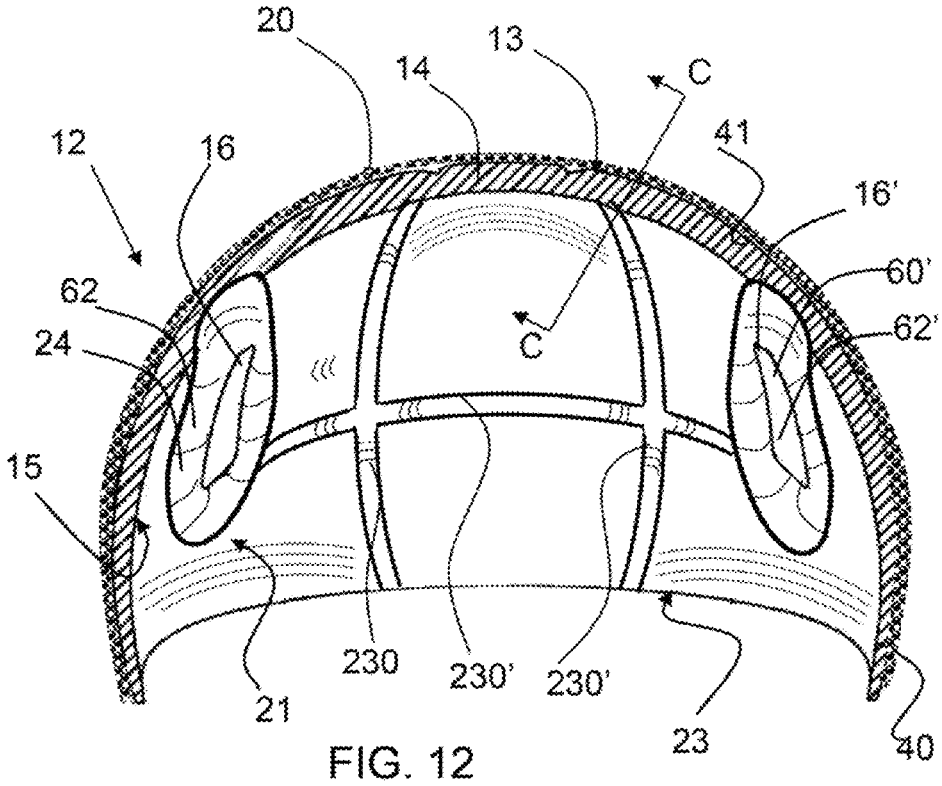

FIG. 12 shows a cut-away view of an exemplary helmet cover having two vents and a plurality of decoupling ribs extending along the inner surface of the helmet cover.

Figure 13A:
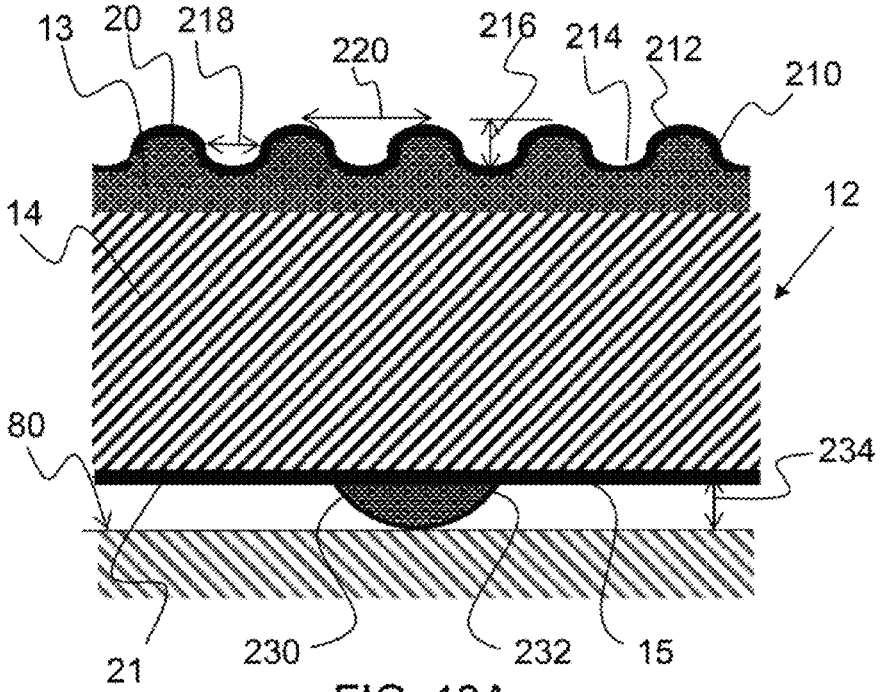

FIG. 13A shows a cut-away view of the exemplary helmet cover shown in FIG. 12 along line CC having a deflection feature on the outer surface and a decoupling rib along the inner surface of the helmet cover.

Figure 13B:
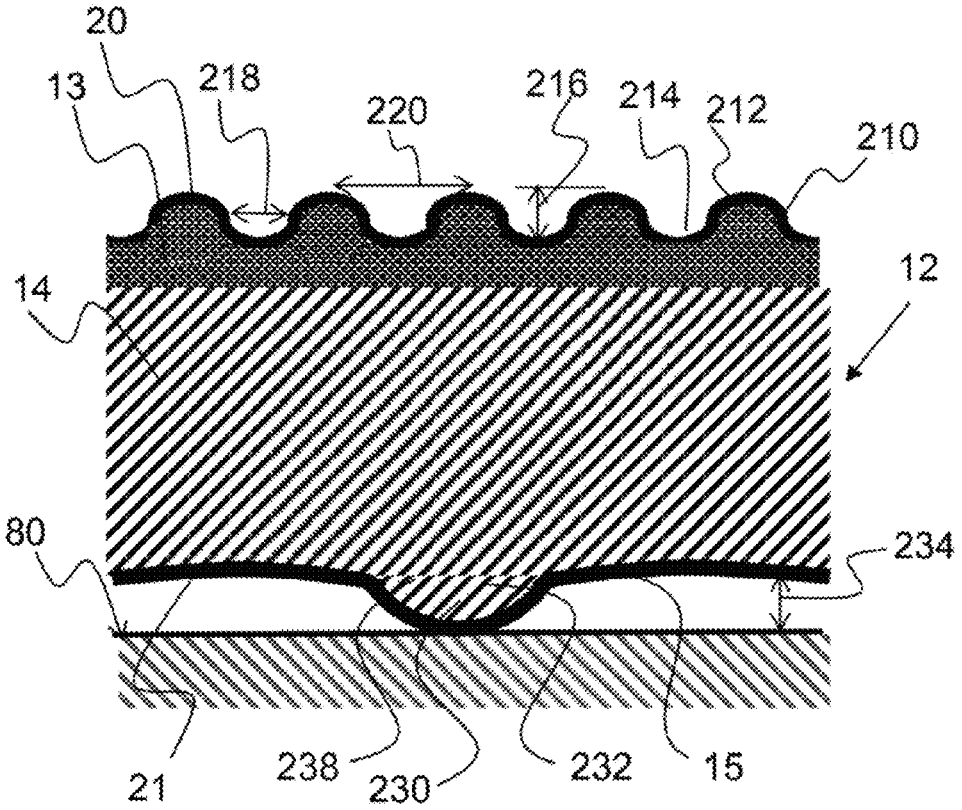

FIG. 13B shows a cut-away view of an exemplary integral decoupling feature.

Figure 14:
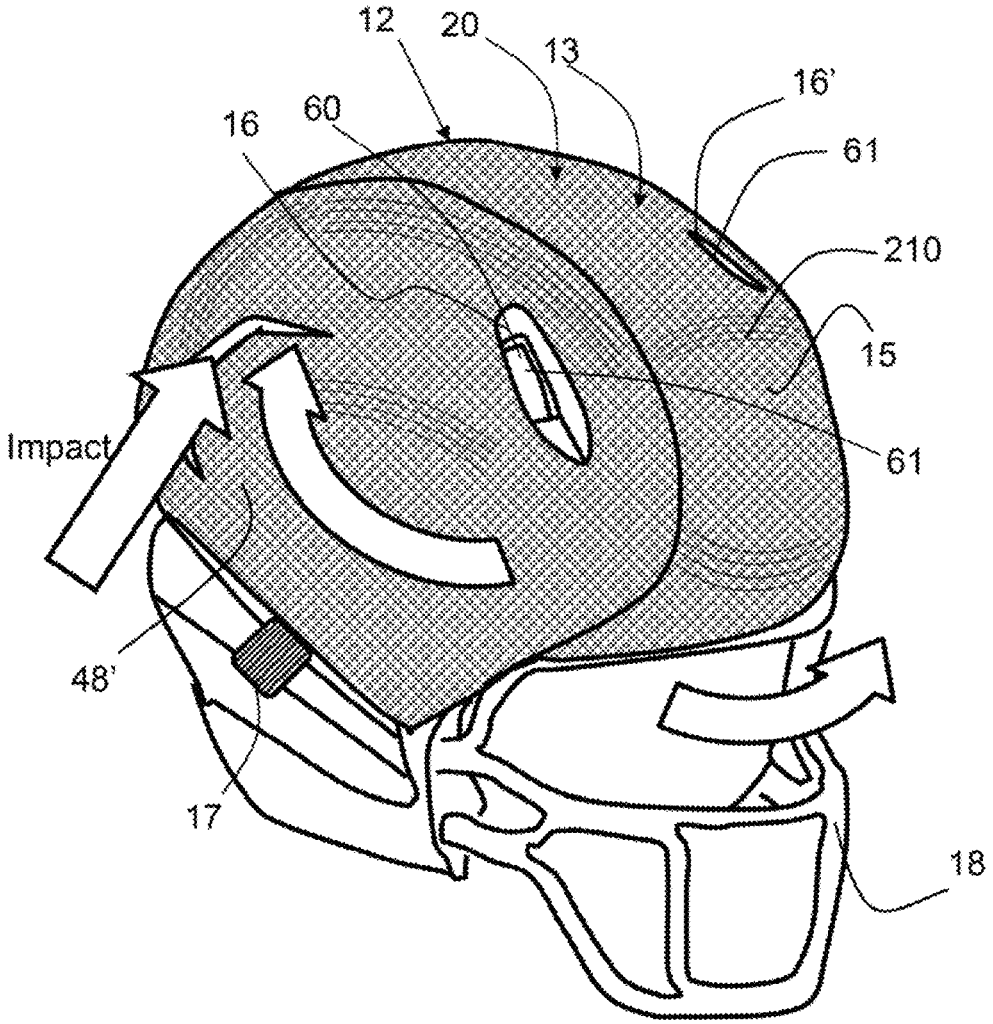

FIG. 14 shows an isometric view of an exemplary helmet cover configured on a helmet and having a deflection feature on the outer surface.

Figure 15:
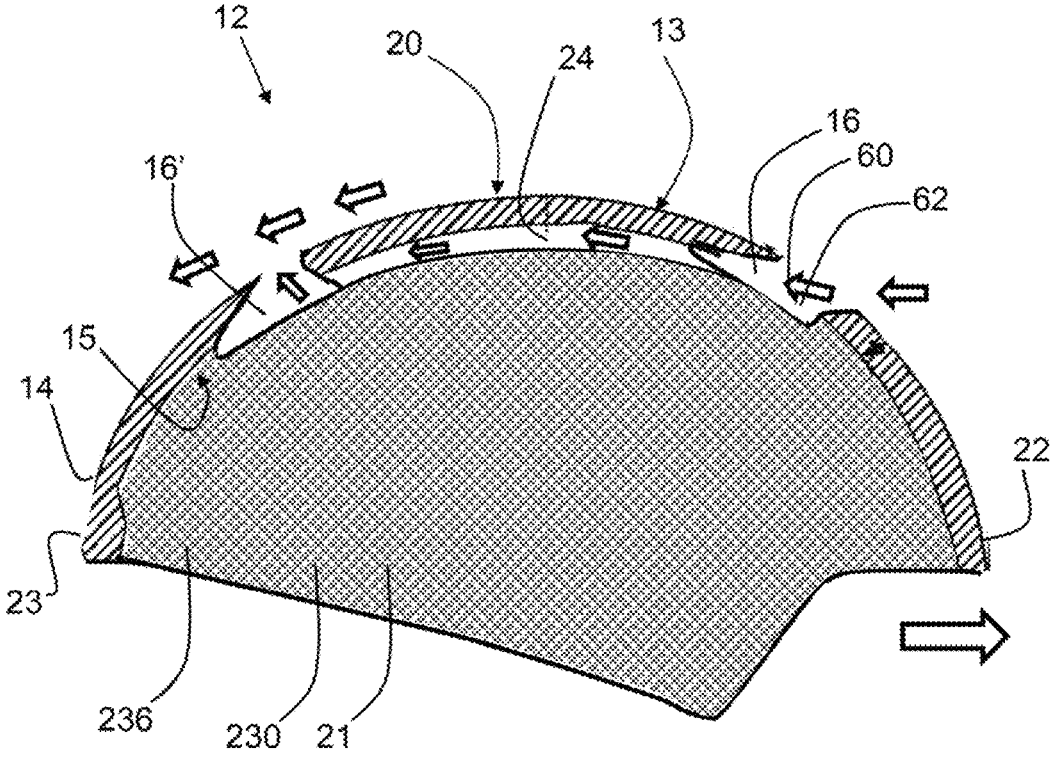

FIG. 15 shows a cut-away view of the exemplary helmet cover shown in FIG. 10, having a decoupling feature configured over the inner surface.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

U.S. Pat. No. 7,328,462, to Albert E. Straus and entitled Protective Helmet, '462, is hereby incorporated by reference in its entirety. The present invention contemplates the use of helmets disclosed in '462 comprising an outer layer comprising the helmet cover as described herein having at least one vent comprising an aperture through said helmet cover. The helmet cover, as described herein, may be an integral part of a helmet, such as a helmet described in '462 and may be permanently attached to the outside surface of a hardened shell. The helmet cover may be attached to any suitable type of base helmet, thereby forming an inventive helmet, as described herein.

DEFINITIONS

Impact sports, as used herein, is defied as any sports where impact with another player, sport equipment, or the ground is common, such as football, field hockey, lacrosse, ice hockey, rugby, boxing, mixed martial arts, baseball, bicycling, mountain biking, skateboarding, roller skating, ice skating, horseback riding, racquetball, wrestling, lacrosse, paintball, soccer, climbing, jet skiing, rafting, kayaking, snow skiing, snowboarding, and the like. Team impact sport refers to impact sports played by two or more players against another team and are typically played in a fixed space, such as a filed or court.

Vent, as used herein, is defined as an aperture through a helmet cover that extends from the outer surface to the inner surface.

Impact absorbing material, as used herein, is defined as a compressible material that may be used to disperse, dampen, or dissipate an impact and includes, but is not limited to, elastomeric materials, open and closed cell foam materials, pleated fabrics, fabrics, composite materials and the like. The impact absorbing material may be a resilient impact absorbing material that effective returns to an original shape after being compressed and deformed. Alternatively, the impact absorbing material may be a non-resilient impact absorbing material that does not return to an original shape after being compressed and deformed, such as styrofoam.

Partially aligned, as used herein, in reference to a helmet cover vent and a helmet vent, means tat the helmet cover vent aperture at least partially overlays a helmet vent, thereby allowing for air flow through the helmet cover and the helmet.

Tapering vent, as used herein, means that a vent aperture is larger in area at the outer surface of the helmet cover than at the inner surface of the helmet cover.

Flared vent, as used herein, means tat a vent aperture has a smaller area at the outer surface of the helmet cove than at the inner surface of the helmet cover.

Air capturing vent, as used herein, means that the vent is configured to capture air as it passes over the outer surface of the helmet cover and may comprise an aperture that is not planar to the outer contour of the helmet cover and/or may comprise a vent leading edge that is recessed, and/or a trailing edge that is elevated from the contour of the helmet cover.

Non-planar, as used herein in reference to a vent aperture on an outer surface of a helmet cover, means that the aperture is not planar with the contour of the helmet and thereby is configured to capture air as, it passes over the helmet cover. A non-planar vent does not follow the contour of the outer surface of the helmet cove, and may comprise one or more protruding or recessed features. Describe a different way, the leading edge of a non-planar vent aperture may be recessed, or a trailing edge of a non-planar vent aperture may be raised from the contour of the helmet cover.

Edge of a helmet, as used herein, means the perimeter of the head insertion opening of the helmet.

As shown if FIG. 1, an exemplary helmet cover 12, comprises a plurality of vents, 16. Two vents 16 and 16' are configured in the top, toward the or leading edge 22 of the helmet cover 12 and the two vents, 16" and 16" (not shown in this view) are configured on the sides. As shown on vent 168', an aperture 60 is configured through the helmet cover. Vent 16' has an outer surface open area 61 that is larger thian the inner surface open area 62, making vent 16' a tapered vent 65. The leading edge 63 of vent 16' comes to a point, whereas the trailing edge 64 is rounded. Any suitable shape of vent or aperture may be used. A flared vent would have an inner surface open area that is larger than the outer surface open area. The side vents 16" and 16" are configured as air capture vents, wherein it is configured to capture air as it passes over the outer surface of the helmet cover. The leading edge width 28 of the aperture on vent 16" is larger than the trailing width 29 of the aperture, and creates a recess 27, or outer surface flow channel 26. This outer surface flow channel, as shown in FIG. 1, is not planar with the outer surface of the helmet cover and would direct air into vent 16". Helmet cover 12, shown in FIG. 1 comprises a outer skin 13.

FIG. 2 shows a top down view of the helmet cover shown in FIG. 1. An outer surface flow enhancer feature 26 is shown extending from the leading edge 22 of the helmet cover. The outer surface flow enhancer feature 26 has a leading with 28 that is greater than the trailing width 29. An air capture vent 67" is shown being configured at the trailing edge of the outer surface flow enhancer feature 26. In addition, both side air capture vents 67 and 67' can be seen in this view.

FIG. 3 shows a cut-away side view along line A of FIG. 2, and shows the inner surface 21, attachment features 17 and inner surface flow enhancer features 24, 24'. The attachment features 17-17", are integral extension 70 type features, having one component of a book and loop fastener 74 attached. These tabs 72 are configured to wrap around the edge of the helmet and attach to the second hook and loop component tat may be attached, such as by an adhesive, to the helmet. Two inner surface flow enhancer features 24, 24' are shown configured on the inner surface 21 of the helmet cover 12. Inner surface flow enhancer feature 24 is recessed, as indicated by the cured contour lines, and extends from the leading edge 22 of the helmet cover to the back of the helmet. Inner surface flow enhancer feature 24', a protrusion from the inner surface 21 contour, extends from the leading edge 22 of the helmet cover past a vent 16, to the trailing edge 23 of the helmet cover. In this configuration, the inner surface flow enhancer feature may increase the amount of ventilation and/or air flow to or from vents.

The impact absorbing material 14 is shown configured been the inner skin 15 and outer skin 13 in FIG. 3. As described, the thickness of the impact absorbing material may vary along the surface of the helmet cover. As shown in FIG. 3, the thickness of the impact absorbing material is relatively uniform.

FIG. 4 shows a cut-away view of an exemplary helmet cover having an attachment feature and an inner surface flow enhancer feature that may allow for air flow from the leading edge of the helmet, along the inside surface of the helmet, to the trailing edged of the helmet. The attachment feature 17 is shown extending from the back or trailing edge of the helmet and is an integral extension 70, configured as a tab 72 having one component of a hook and loop fastener 74 attached thereto. The inner surface flow enhancer feature 24 is a recessed area configured around the vent 16. The thickness of the impact absorbing material 14, varies along the contour of the helmet cover 12, with the impact absorbing material being thinner toward the edges of the helmet cover and thicker towards the top of the helmet cover.

FIG. 5 shows an isometric view of an exemplary helmet cover having interchangeable pads 46. As shown in FIG. 5, two different discrete pads 44 and 46 may be attached to the helmet cover. Discrete pad 44' is shown as a darker interchangeable pad 46', indicating that it has greater impact absorbing properties. As described, discrete pad 44' may be thicker, or have a higher density than discrete pad 44, or may comprise a different impact absorbing material. Pad recesses 48 and 48' are shown in the helmet cover for the placement of the discrete pads. The discrete pads may be placed into the recesses, as indicated by the arrows, and retained or attached to the helmet cover in any suitable way. Fasteners, tabs, integral extensions from the inner or outer skin, for example, may be used to attach a discrete pad to a helmet cover.

FIG. 6 shows an isometric view of an exemplary helmet cover 12 having a vent opening 16 configured to at least partially align with a helmet vent 19 opening in a helmet 18. An aperture 60 of the helmet cover 12, or the open area on the inner surface 62 of the helmet cover, may be configured to at least partially align with a helmet vent aperture 90, or open area on the helmet outer surface. An aligned vent may extend from the outer surface of the helmet cover to the inner surface of the helmet, thereby providing direct ventilation from the interior of the helmet to the outside of the helmet cover. Any number of aligned vents may be configured in a helmet comprising a helmet cover including, but not limited to, one or more, two or more, four or more, six or more and any range between and including the number of vents provided. The helmet 18 comprises a plurality of attachment features 17, 17', such as a book and loop fastener configured on the outer surface of the helmet, and particularly on the dome portion of the outer surface. These fasteners may be configured to align and couple with a book ad loop fastener configured on the inside surface of the helmet cover, such as those shown in FIG. 9. In one embodiment, the helmet cover is an integral helmet cove and is a permanent part of the helmet that may be molded around at least a portion of the outer surface of a helmet. An integral helmet cover, as used herein, is permanently attached to a helmet and is not detachably attachable. A face guard 100 may be attached to the helmet or to the helmet cover in any suitable way, including as taught in U.S. Pat. No. 7,328,462 to Straus.

As shown in FIG. 7, an exemplary helmet cover 12 has a pair of inner surface flow enhance features 24, 24' that extend around the open area 62, 62' of the vents 16, 16' respectively. The aperture 60' extends from the outer surface 20 of the helmet cover to the inner surface 21. The inner surface flow enhancer features provide additional area for the flow of air to impinge on a helmet surface. The inner surface flow enhancers shown are recess from the contour of the inner surface.

As shown in FIG. 8, an exemplary helmet cover 12 has two inner surface flow enhancer features 24" and 24'" that extend between to vents 16, 16'. These inner surface flow enhancer features are protrusions from the inside surface 21 of the helmet cover and create a channel for flow between the to protrusions.

As shown in FIG. 9, an exemplary helmet cover 12 has an inner surface flow enhancer feature 24 that extends between a vent 16 configured in the front portion 34 of the helmet cover and a vent 16' configured in the back portion 36 of the helmet cover. The vents are configured to channel air from the first vent 16, along the inner surface flow enhance and out the second vent 16', when moving in a forward direction, as indicated by the large arrow. Also shown in FIG. 9 are attachment features, 17, 17' configured on the inner surface of the helmet cover. A first attachment feature 17 is configured in a recess 77 along the front portion, or leading edge of the helmet and a second attachment feature 17' is configured within a recess 77' on the side portion of the inner surface 21. These two attachment features may be a hook-and-loop fastener material 24 that are configured to align with the opposing portion of hook-and-loop fattener material configured on the outside of a helmet, as shown in FIG. 6.

FIG. 10 shows a cut-away view of the exemplary helmet cover 12 shown in FIG. 9 along line BB. The helmet cover has an inner surface flow enhancer feature 24 that extends between a vent 16 configured in the front portion of the helmet and a vent 16' configured in the back portion of the helmet. The arrows indicate the direction of air flow into the front vent, along the inner surface flow enhance and out the second back vent. The vent configured in the back of the helmet may have a geometry configured to produce a low pressure when air is flowing over the vent as indicated by the arrows. A venturi effect may be produced in the second vent, whereby air flowing over the vent creates a suction force to draw air up and out of the vent. A front vent may be configured to capture air when moving in a forward direction as shown.

This combination of vent geometries may greatly increase the amount of flow into the inside surface of the helmet cover or through an inner surface flow enhancer.

As shown in FIG. 1, an exemplary helmet cover 12 has a plurality of different thickness interchangeable pads 46-46". Interchangeable pad 46 is much thinner than interchangeable pad 46". A user may choose interchangeable pad 46' for practice sessions when there is going to be a lot of contact. Interchangeable pad 46' may extend out from the outer surface of the helmet cover whereas interchangeable pad 46 may be substantially flush with the outside surface of the helmet cover when installed in the pad recess 48. A person may choose to install interchangeable pad 46 for game situations, for example. Logos ad other words and/or symbols may be configured on the interchangeable pads including team logos and names for example. In addition, an interchangeable pad may be provided in different colors to allow a coach to divide a team into different squads for practice, such as a blue squad, having blue colored interchangeable pads and a red squad, having red interchangeable pads installed on their helmet covers.

As shown in FIG. 12, an exemplary helmet cover 12 has two vents 16, 16' and a plurality of decoupling ribs, 230-230", extending along the inner surface 21 of the helmet cover. The decoupling ribs reduce the contact surface area between the inner surface of the helmet cover and the outside surface of the helmet, thereby reducing friction and allowing for motion or rotation of the helmet cover with respect to the helmet. Any number and any configuration of decoupling features may be employed. In addition, the decoupling features may further dampen an impact as the decoupling features would have to be compress or deflect before a larger portion of the inner surface area of the helmet cover contacts the outer surface of the helmet.

FIG. 13A shows a cut-away view of the exemplary helmet cover 12 shown in FIG. 12 along line CC. The cut-away shows a deflection feature 210 on the outer surface 20 of the helmet cover and a decoupling feature 230, or rib 232 along the inner surface 21 of the helmet cover. The height of the decoupling rib provides a reduce contact surface area between the inner surface of the helmet cover and the outside surface of the helmet 80. The decoupling feature is attached to the inner skin 15 in this exemplary embodiment. As described herein, the decoupling feature may be harder than the inner skin and the impact absorbing material. A decoupling feature may comprise a hard plastic such as polyester, or polyethylene and may have a shore A hardness of about 40 or more, about 60 or more, about 80 or more and any range between and including the values provided. A hard decoupling feature may more easily slide along the outside surface of a helmet 80. In addition, a hard decoupling feature will dampening an impact as a larger portion of the impact absorbing material will have to deform before the inner skin layer contacts the outside surface of the helmet. The height of the decoupling feature 234 provides an impact dampening distance. The deflection feature 210 comprises a plurality of dimples 214 and protrusion 212. The height of the protrusion or depth of the dimples 216 may be any suitable dimension as described herein. The surface area of the outermost outside surface 20 of the helmet cover is reduce by the deflection feature. The dimples have a diameter 218, and a center-to-center dimension 220.

As shown in FIG. 13B, an exemplary integral decoupling feature 238 comprises a raised portion of the inner skin layer 15. An integral decoupling feature is defied herein as a decoupling feature that has a raised outer portion defined by an inner skin layer, as shown in FIG. 13B. It is contemplated that an inner skin layer may be formed before, during or after the attachment to the impact absorbing material 14. For example, an inner skin layer 15 may be formed to comprise a plurality of ribs, dimples and/or protrusion and a foam impact absorbing material may be cast and/or otherwise adhered to the formed inner skin layer. As shown in FIG. 13B, the impact absorbing material conforms to decoupling feature rib 232. In another embodiment, the decoupling features may be formed in an inner skin layer and impact absorbing material composite subsequent to the attachment of the inner skin layer to the impact absorbing material. The composite may be formed through heat and pressure in a mold, for example.

As shown in FIG. 14, an exemplar helmet cover 12 is configured on a helmet 18 and has a deflection feature 210 on the outer surface 20. The deflection feature will cause an impact to deflect away from the helmet as the friction of impact will be reduced. The helmet cover is also configured with a decoupling feature (not shown) that allows the helmet cover to move in the direction of impact and relative to the helmet as indicated by the large arrows. The impact causes the helmet cover to rotate or twist clockwise with the impact and relative to the helmet.

As shown in FIG. 15, a helmet cover 12 comprises a decouple feature 230 over the interior or inner surface 21. The decoupling feature comprises a plurality of dimples and raised protrusions tat reduce the area of contact between the helmet cover and the helmet.

It will be apparent to those skilled in the art that various modifications, combinations and variations can be made in the present invention without departing from the sprit or scope of the invention. Specific embodiments, features and elements described herein may be modified, and/or combined in any suitable manner. Thus, it is intended that the present invention cove the modifications, combinations and variations of this invention provided they come within the scope of the appended claims and their equivalents.

What is claimed is:

1. An article comprising a helmet cover comprising:

a top portion;

two opposing side portions that extend down from said top portion;

a front portion;

a back portion;

an outside surface;

an outer skin configured on said outside surface formed of a plastic material;

wherein the outer skin consists of a hard plastic material having low friction properties and a shoe A hardness of 60 or more:

an impact deflection feature formed in the outer skin and comprising a plurality of dimples extending inward from the outside surface to provide a reduced area of contact with a second helmet;

wherein the dimples are configured inward from the outside surface of the helmet cover extending from the front portion to the top portion, from the top portion to the back portion and from the top portion down the two opposing side portions of the helmet cover;

an inside surface having an inner skin layer;

an impact absorbing material configured between the inner and outer skin and attached to the outer skin and having an original shape;

wherein the impact absorbing material is a resilient foam that returns to said original shape after being compressed and deformed;

wherein said helmet cover is dome shaped and extends over a helmet from the front to the back and down the two opposing side portions to cover an outer surface of said helmet; and wherein the plastic material of the outer skin is a harder material than said impact absorbing material.

2. The article comprising a helmet cover of claim 1, further comprising at least one decoupling feature comprising a protrusion extending from the inner surface of said helmet cover; whereby in use, the decoupling feature allows the helmet cover to move with respect to the helmet.

3. The article comprising a helmet cover of claim 2, wherein the protrusion has a cured outer surface.

4. The article of claim 2, wherein the decoupling feature is formed out of the inner skin layer and is made out of a plastic material.

5. The article comprising a helmet cover of claim 2, wherein the at least one decoupling feature is an integral decoupling feature comprising a raised portion of the inner skin layer.

6. The article of claim 1, further comprising a helmet wherein the helmet cover is configured to be detachably attachable to a said helmet.

7. The helmet cover of claim 1 further comprising:

at least two vents wherein each vent comprises an aperture that extend from the outside surface to the inside surface;

an inner surface flow enhancer feature comprising a channel that extends along the inside surface of the helmet cover from at least one of paid apertures and configured to increase air flow between the helmet cover and the helmet.

8. The article of claim 7, wherein the channel extends between a first aperture of a first vent and a second aperture of a second vent.

9. The article of claim 8, wherein the first aperture is configured proximate a leading edge of the helmet cover and the second aperture is configured proximate a trailing edge of the helmet cover, whereby a flow of air from the outside surface of the helmet cover is configured to flow through said first aperture, along the inner surface flow enhancer and out said second aperture, thereby creating a flow of air between the helmet cover and the helmet when the helmet cover is moving in a forward direction.

10. The article of claim 7, wherein the channel extends to a leading edge of said helmet cover.

11. The article of claim 7, wherein the channel extends to an edge of said helmet cover.

12. The helmet cover claim 1 further comprising:

a discrete and interchangeable pad configured to be attached to the helmet cover and form a portion of an outer surface of the helmet cover.

13. The article of claim 12, wherein the discrete and interchangeable pad has an outer perimeter and a portion of said outer perimeter of forms an edge of the helmet cover when attached to said helmet cover.

14. The article of claim 12, wherein the discrete and interchangeable pad has an outer perimeter that is configured to be secured within a pad recess.

15. The article of claim 12, comprising a plurality of discrete and interchangeable pads configured to fit into a pad recess, wherein a first discrete and interchangeable pad has a first thickness and a second discrete and interchangeable pad has a second thickness that is different than said first thickness.

16. The article of claim 12, comprising a plurality of discrete and inter changeable pads configured to fit into a pad recess, wherein a first discrete and interchangeable pad has a first hardness and a second discrete and interchangeable pad has a second hardness that is greater than said first hardness.

* * * * *